US006013424A

United States Patent [19]

Schmittou et al.

[11] Patent Number: 6,013,424

[45] Date of Patent: Jan. 11, 2000

[54] PHOTOGRAPHIC FIXING COMPOSITION CONTAINING AMINOALKYLTRIAZOLE AND METHOD OF RAPID PHOTOGRAPHIC PROCESSING

[75] Inventors: Eric R. Schmittou, Rochester; David G. Foster, West Henrietta, both of N.Y.

[73] Assignee: Eastman Kodak Company, Rochester, N.Y.

[21] Appl. No.: 09/250,951

[22] Filed: Feb. 16, 1999

[51] Int. Cl.[7] ..... G03E 7/42

[52] U.S. Cl. ..... 430/455; 430/393; 430/459

[58] Field of Search ..... 430/455, 459

[56] References Cited

U.S. PATENT DOCUMENTS

| | | | |
|---|---|---|---|
| H953 | 8/1991 | Goto et al. . | |
| 4,960,683 | 10/1990 | Okazaki et al. . | |
| 5,026,629 | 6/1991 | McGuckin et al. . | |
| 5,183,727 | 2/1993 | Schmittou et al. . | |
| 5,298,373 | 3/1994 | Sasaoka et al. . | |
| 5,401,621 | 3/1995 | Kojima et al. . | |
| 5,415,983 | 5/1995 | Kojima et al. . | |
| 5,424,176 | 6/1995 | Schmittou et al. . | |
| 5,633,124 | 5/1997 | Schmittou et al. . | |
| 5,814,437 | 9/1998 | Nakahanada et al. | 430/455 |

FOREIGN PATENT DOCUMENTS

| | | |
|---|---|---|
| 0 189 603 | 8/1986 | European Pat. Off. . |
| 0 466 510 | 1/1992 | European Pat. Off. . |
| 0 500 045 | 8/1992 | European Pat. Off. . |
| 0 513 766 | 11/1992 | European Pat. Off. . |
| 0 712 040 | 5/1996 | European Pat. Off. . |
| 0 329 052 | 10/1996 | European Pat. Off. . |

OTHER PUBLICATIONS

Japenese Abstract No. 5034872.
European Abstract No. 610763.
Japanese Abstract No. 7120895.
Japanese Abstract No. 8248582.
Japanese Abstract No. 9005964.
Japanese Abstract No. 58122535.
Japanese Abstract No. 1004739.

*Primary Examiner*—Hoa Van Le
*Attorney, Agent, or Firm*—J. Lanny Tucker

[57] ABSTRACT

Color photographic silver halide elements, such as color films, can be rapidly fixed using a fixing composition containing a thiosulfate fixing agent, and certain aminoalkyl- and sulfur-substituted 1,2,4-triazoles. Each of the components is present in specific amounts to effect rapid and efficient desilvering. The composition also includes predominantly ammonium cations (at least 50 mol %). Besides effective and rapid silver removal (less than 60 seconds), the fixing composition also minimizes residual dye stain from sensitizing dye aggregates within the photographic elements.

24 Claims, No Drawings

PHOTOGRAPHIC FIXING COMPOSITION CONTAINING AMINOALKYLTRIAZOLE AND METHOD OF RAPID PHOTOGRAPHIC PROCESSING

PENDING APPLICATIONS

Reference is made to the following:

Copending and commonly assigned U.S. Ser. No. 09/223,292 filed on Dec. 30, 1998, by Schmittou and Foster and entitled "Photographic Fixing Composition with Mixture of Fixing Agents and Method of Rapid Processing".

Copending and commonly assigned U.S. Ser. No. 09/223,597 filed on Dec. 30, 1998, by Foster and Schmittou and entitled "Photographic Fixing Composition and Method of Rapid Photographic Processing."

Copending and commonly assigned U.S. Ser. No. 09/250,943 filed on even date herewith by Schmittou and Foster and entitled "Photographic Fixing Composition Containing An Oxadiazolethione and Method of Rapid Photographic Processing."

Copending and commonly assigned U.S. Ser. No. 09/244,562 filed on even date herewith by Schmittou and Foster and entitled "Photographic Fixing Composition Containing 1,3-Thiazolidine-2-thione and Method of Rapid Photographic Processing."

FIELD OF THE INVENTION

This invention relates in general to photography. More particularly, it relates to a photographic fixing composition, and to a method of rapidly processing color photographic silver halide elements using that composition while obtaining low levels of dye density stain.

BACKGROUND OF THE INVENTION

The basic image-forming process of silver halide color photography comprises the exposure of a silver halide color photographic recording material to actinic radiation (such as light) and the manifestation of a useful image by wet chemical processing of the material. The fundamental steps of this wet processing include color development to reduce silver halide to silver and to produce dye images in exposed areas of the material. During or after bleaching to oxidize metallic silver to silver(I), the silver(I) is generally removed by dissolving it in a silver(I) solvent, commonly known as a fixing agent. Conventional fixing steps generally require up to 6 minutes in large photoprocessing operations, and up to 2 minutes in small "minilabs" or small processing machines.

In some photochemical processes, bleaching and fixing are combined in a bleach-fixing step using a composition that includes both a bleaching agent to oxidize metallic silver and a fixing agent to dissolve the remaining silver(I).

A wide variety of fixing agents and silver solvents are known, as described for example in U.S. Pat. No. 5,633,124 (Schmittou et al) and publications noted therein. Thiosulfate salts are generally prefered as fixing agents because they are inexpensive, highly water soluble, non-toxic, non-odorous, and stable over a wide pH range. Thus, fixing is usually accomplished using a thiosulfate fixing agent that diffuses into the clement, and forms silver thiosulfate complex that diffuses out of the element. In large photofinishing labs, the elements are usually immersed in a fixing solution for from 4 to 6 minutes. In small minilabs, the fixing time is shorter, that is from 90 to 120 seconds.

In processing some photographic elements, such as color negative photographic films, there is a need to reduce density from stain resulting from sensitizing dye aggregates formed from sensitizing dyes commonly included in the elements to increase silver halide spectral sensitivity. After the photographic elements are exposed, the spectral dyes are no longer needed, and the aggregates they form interfere with the absorption characteristics of the colored dyes that provide the final color images.

When using conventional fixing times, the unwanted dye aggregates disappear after the prescribed lengthy fixing and stabilizing (or washing steps). Substantial amounts of the sensitizing dyes remain in the color negative films after processing, but they are in invariant and unaggregated forms that absorb blue and green light. The absorbance by the retained unaggregated sensitizing dyes can be compensated for when final positive images are produced from the negative film images. However, when the fixing time is shortened, dye aggregates and resulting dye stains remain. This problem in the original image (such as color negative film images) is unacceptable in the photographic industry. It is also unacceptable for such images as color slides or transparencies, color prints or electronic images obtained from scanning original images.

It is well known that the rate of silver dissolution (or complexation) by thiosulfate fixing agents increases with increasing thiosulfate concentration until a maximum rate is reached. After this maximum rate is reached, the rate of silver dissolution decreases as the thiosulfate concentration is increased further. Consequently, other compounds are routinely incorporated into fixing solutions to act as co-fixing agents or fixing accelerators to improve silver removal. Thiocyanate is one of the most common compounds used for this purpose.

There are several fixing solutions available in the marketplace containing a combination of thiosulfate and thiocyanate for use in a 90–120 second fixing step. One such product is available as KODAK FLEXICOLOR RA Fixer Replenisher NR having thiosulfate and thiocyanate at 0.8 and 1.2 mol/l, respectively (1:1.5 molar ratio).

There are also numerous literature references to the combination of thiosulfate and thiocyanate including EP-A-0 610 763 (Buttner et al) that describes fixing for 90 to 240 seconds. However, this publication fails to appreciate the need to avoid sensitizing dye aggregate stains.

EP-A-0 712,040 (Ueda et al) described the inclusion of organic sulfur-substituted compounds in fixing solutions that contain only thiosulfate. EP-A-0 189,603 (Rutges et al) describes the use of mercaptotriazole and thiosulfate in a combined fixing-stabilizing solution for processing silver halide materials containing at least 50 mol % silver chloride. EP-A-0 500,045 (Kojima et al) describes the use of mercaptoazoles as fixing agents.

U.S. Pat. No. 4,960,683 (Okazaki et al) describes the use of various heterocyclic thiols in thiosulfate fixers, in subsequent wash solutions, or in subsequent stabilizing solutions for the purpose of removing and washing out sensitizing dyes from black-and-white photographic materials. There is no mention of the action of such heterocyclic thiols on sensitizing dyes in silver halide color photographic systems, particularly aggregated sensitizing dye color negative film systems. The break-up of sensitizing dye aggregates into unaggregated forms and the elimination of aggregated sensitizing dye stain are the subjects of our invention.

Rapid processing can be achieved by using a combination of specific amounts of a thiosulfate and a thiocyanate fixing agents, as described in U.S. Ser. No. 09/223,292 filed on Dec. 30, 1998, by Schmittou et al (noted above). Fixing was achieved for 60 seconds or less using that invention.

In addition, further rapid processing was achieved by using a combination of fixing agents with specific sulfur-substituted triazoles, as described in U.S. Ser. No. 09/223,597 filed on Dec. 30, 1998, by Foster and Schmittou (noted above).

Despite these improved processing methods, there is a continuing need to provide images in photographic elements in a rapid fashion. The industry is attempting to provide images to customers in less time, and thus a time reduction in any of the processing steps, including fixing, is highly desirable. Besides rapid processing, there is also a need to eliminate unwanted dye stain resulting from sensitizing dye aggregates.

SUMMARY OF THE INVENTION

An advance is provided in the art with a fixing composition comprising:

a) at least 0.5 mol/l of a thiosulfate fixing agent, and b) at least 0.001 mol/l of a triazole of Structure I, II or III or any of their tautomeric forms:

I

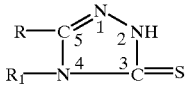

II

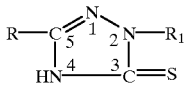

III

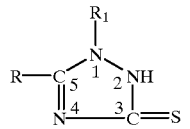

wherein R and $R_1$ are independently hydrogen or a monovalent substituent, provided that the triazole of Structure I, II or III or any of their tautomeric forms has at least one aminoalkyl group that has up to 12 carbon atoms in the alkyl portion attached to the triazole ring, and any two adjacent substituent or aminoalkyl groups can together form a fused ring with the triazole ring, provided that R and $R_1$ are not both hydrogen and neither is an amino group, wherein the concentration of ammonium ions is at least 50 mol % of all cations in the composition.

This fixing composition can be used in a method for photographic processing by contacting an imagewise exposed and color developed color photographic silver halide element with the fixing composition described above for up to 60 seconds.

We have found that shortened fixing times for photographic processing can be carried out with successful silver removal and reduction of sensitizing dye aggregate stain by using a thiosulfate fixing agent, with or without a thiocyanate fixing agent, and certain aminoalkyl- and sulfur-substituted 1,2,4-triazoles as the essential components of the fixing composition of this invention. In particular, the addition of the specific triazole compound to the fixing composition improves photographic fixing over known fixing compositions. Moreover, the concentration of ammonium cations in the composition should be at least 50 mol % of all cations. In the practice of this invention, at least 95% of the original removable silver(I) is dissolved during fixing with the present invention, and the residual stain density from residual sensitizing dye aggregates is less than 0.05 density units within the region of 600–700 nm. Further details of how these advantages are accomplished are provided below.

DETAILED DESCRIPTION OF THE INVENTION

The fixing compositions used in this invention generally have a pH of from about 4 to about 8 when in aqueous form. Preferably, the pH is from about 5 to about 8, and more preferably, it is from about 6 to about 8.

The fixing composition can be packaged and transported as a dry or liquid formulation, working strength solution, or as a single-part concentrated composition. It can be used as a replenisher as well as the initial tank working solution.

It should be understood that the fixing compositions of this invention are intended for rapid and efficient removal of silver(I) from color photographic elements, either before, during or after bleaching or any combination of these. In the case of bleach-fixing, the fixing composition of this invention can also include useful amounts of one or more bleaching agents (such as iron chelates) that are purposely added to the fixing composition in some manner. Preferably, however, the useful fixing compositions have fixing activity only (no purposely added bleaching agents), and the only bleaching agents that may be present in the fixing composition are those carried over from a preceding bleaching solution by the photographic element being processed.

The first essential component in the fixing composition is a thiosulfate fixing agent. The thiosulfate can be provided as sodium thiosulfate, potassium thiosulfate, ammonium thiosulfate, lithium thiosulfate, calcium thiosulfate, or magnesium thiosulfate, or mixtures thereof such that a desired concentration of thiosulfate ion is provided. Preferably, ammonium or sodium thiosulfate (or a mixture thereof) is used.

Optionally, a thiocyanate fixing agent can also be present as a fixing agent especially for more rapid silver removal. If present, it can be provided as sodium thiocyanate, potassium thiocyanate or ammonium thiocyanate, or mixtures thereof. Preferably ammonium or sodium thiocyanate (or mixtures thereof) is used.

Preferably, the fixing composition has at least one thiosulfate fixing agent and at least one thiocyanate fixing agent, with the total concentrations of fixing agents being within the ranges described herein.

One or more organic sulfur-substituted triazoles of Structure I, II or III are included in the fixing composition as a second essential component.

I

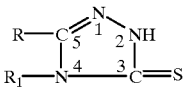

II

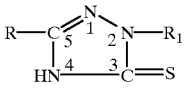

-continued

III

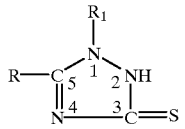

wherein R and $R_1$ are independently hydrogen or a monovalent substituent generally having up to 12 non-hydrogen atoms (for example, carbon, nitrogen, oxygen, phosphorus and sulfur atoms), as long as at least one substituent on the triazole ring is an aminoalkyl group having up to 12 carbon atoms in the alkyl portion of the aminoalkyl group. In addition, R and $R_1$ are not hydrogen at the same time, and neither is an amino group.

Particularly useful monovalent substituents for R and $R_1$ are aliphatic, alicyclic and aromatic groups as defined below. In addition, two adjacent substituents on the triazole ring (or any tautomeric form thereof) can be combined to form a fused ring. Such fused rings can have from 5 to 8 carbon, oxygen, sulfur or nitrogen atoms, including the 2 atoms shared with the triazole ring.

Particularly useful aliphatic, alicyclic and aromatic groups include but are not limited to substituted or unsubstituted alkyl groups each having 1 to 8 carbon atoms in the alkyl portion (such as methyl, ethyl, isopropyl, t-butyl, hexyl, benzyl, methoxymethyl, 2-sulfoethyl, carboxymethyl, hydroxyethyl, hydroxymethyl, methylthiomethyl, carboxymethylthioethyl, phosphonomethyl and hydroxyethoxyethyl), substituted or unsubstituted cycloalkyl groups each having 5 to 10 carbon atoms in the ring structure (such as cyclopentyl, cyclohexyl, 4-methoxycyclohexyl, 3-methylcyclohexyl, 4-carboxycyclohexyl, 3-sulfocyclohexyl, 2-hydroxycyclopentyl), substituted or unsubstituted carbocyclic aryl groups each having 6 to 10 carbon atoms (such as phenyl, p-methoxyphenyl, m-methylphenyl, naphthyl, 2-carboxyphenyl, 3-hydroxyphenyl, 4-sulfophenyl, 2-methylthiophenyl), substituted or unsubstituted alkoxy groups each having 1 to 10 carbon atoms (such as methoxy, ethoxy, t-butoxy, methoxyethoxy, methylthioethoxy, 2-hydroxyethoxy, 2-carboxyethoxy, 2-sulfoethoxy and phenylmethoxy), substituted or unsubstituted aryloxy groups each having 6 to 10 carbon atoms in the carbocyclic ring (such as phenoxy, naphthoxy, 2-hydroxyphenoxy, 4-sulfophenoxy, 3-carboxyphenoxy and p-methylphenoxy), acyl groups having 2 to 8 carbon atoms (such as acetyl, formyl, benzoyl, 2-carboxybenzoyl, 3-sulfobenzoyl, 4-hydroxybenzoyl and 2-carboxypropionyl), substituted or unsubstituted heterocyclyl groups having 5 to 10 carbon, sulfur, nitrogen or oxygen atoms in the ring (including both aromatic and nonaromatic heterocyclyl groups, such as morpholino, 2-pyridyl, 2-imidazolyl, 2-imidazolidinyl, 2-pyrimidinyl, 2-thiazolyl, 2-thiazolidinyl, 2-oxazolyl and 2-oxazolidinyl), substituted or unsubstituted alkylthio groups having 1 to 8 carbon atoms (such as methylthio, metlioxyethylthio, methylthioethylthio, 2-hydroxyethylthio, carboxymethylthio and 2-sulfoethylthio), and substituted or unsubstituted arylthio groups having 6 to 10 carbon atoms in the ring (such as phenylthio, 2-carboxyphenylthio, 4-sulfophenylthio, 3-hydroxyphenylthio and 1- or 2-naphthylthio).

Where the triazole ring includes two adjacent monovalent substituents that are combined, the resulting fused ring can be saturated or unsaturated (for example an imidazole ring, an oxazole ring, a thiazole ring, pyrrolidine ring or a pyrimidine ring).

As noted above, the triazole ring must have at least one aminoalkyl group wherein the amino portion of the group is attached to the ring through a divalent alkylene group. Preferably, either R or $R_1$ is the desired aminoalkyl group.

Particularly useful aminoalkyl groups that have at least one amino substituent include, but are not limited to, substituted or unsubstituted, linear or branched alkyl groups each having 1 to 12 carbon atoms (such as amino-substituted methyl, ethyl, isopropyl, t-butyl, hexyl, benzyl, methoxyethyl, 2-sulfoethyl, carboxymethyl, hydroxyethyl, methylthioethyl, carboxymethylthioethyl and phosphonomethyl, and hydroxyethoxyethyl). Thus, the alkyl portion of the aminoalkyl group can have otier substituents as well as one or more amino substituents. Useful amino substituents include primary, secondary and tertiary amino groups (such as $-NH_2$, methylamino, ethylamino, N,N-dimethylamino, carboxymethylamino, 2-sulfoethylamino, 2-hydroxyethylamino, acetylamino, phosphonomethylamino, methylthioethylamino, 3-sulfophenylamino, bis(2-hydroxyethyl)amino and quaternary salts), including cyclic amino groups (such as morpholino). The alkyl portion of the aminoalkyl group preferably has 1 to 8 carbon atoms. More preferably, the triazole ring has an dimethylaminoethyl, diethylaminoethyl or morpholinoethyl group.

In addition, two adjacent substituents, including at least one aminoalkyl group, on the triazole ring (or any tautomeric form thereof) can be combined to from a fused ring. Such fused rings car have from 5 to 8 carbon, oxygen, sulfur or nitrogen atoms, including the two atoms shared with the triazole ring.

The triazole ring of Structure I, II or III must have at least one aminoalkyl group, and in some embodiments, it can have two such groups that may be the same or different. Preferably, at least one such aminoalkyl group is attached to the 2-, 4- or 5-position, and more preferably at the 4-position, of the triazole ring. If there are two aminoalkyl groups attached to the triazole ring, they can be in the 4- and 5-positions, or the 2- and 5-positions.

As one skilled in the art would understand, the compounds shown in Structure I, II and III can also exist in their tautomeric forms wherein the =S group is a —SH group.

Representative useful sulfur-substituted compounds of Structure I, II or III include, but are not limited to the following (Compounds 1–8:

1

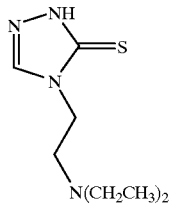

2

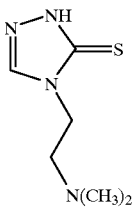

-continued

3

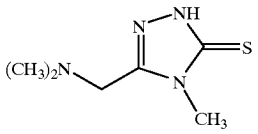

4

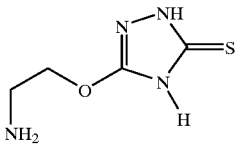

5

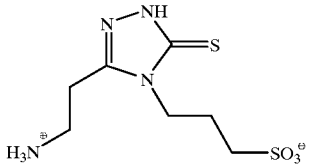

6

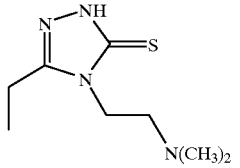

7

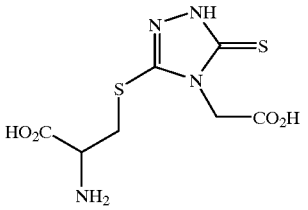

8

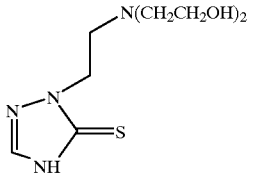

Compounds 1 and 2 are preferred. Other useful compounds would be readily apparent to one skilled in the art in view of the teaching included herein.

The thiosulfates and thiocyanates can be obtained from a number of commercial sources or prepared using conventional starting materials and synthetic procedures. Compounds of Structure I, II arid III can be prepared using a synthetic method similar to that described below for Compound 1.

The concentrations of the essential components of the fixing composition of this invention are listed in TABLE I below wherein all of the ranges of concentrations are considered to be approximate (that is "about").

TABLE I

| COMPONENT | GENERAL CONCENTRATION (mol/l) | PREFERRED CONCENTRATION (mol/l) |
|---|---|---|
| Thiosulfate ions | 0.5–1.6 | 0.8–1.5 |
| Structure I compound | ≧0.001 | 0.005–0.05 |
| Ammonium ions | ≧50 mol % of all cations | >75 mol % of all cations |

If a thiocyanate fixing agent is used in the fixing composition, it is generally present in an amount of at least 2 mol/l, and preferably at from about 2 to about 3 mol/l.

Optional addenda that can be present in the fixing composition if desired are materials that do not materially affect the photographic fixing function of the composition. Such materials include, but are not limited to, biocides, a source of sulfite or bisulfite ion, alkyl- or arylsulfinic acids or their salts, halides (such as bromide ions, chloride ions or iodide ions), photographic hardeners, metal ion sequestering agents, buffers, fixing accelerators and other materials readily apparent to one skilled in the photographic art. These and other optional materials can be present in conventional amounts (for example as described in U.S. Pat. No. 5,633,124, noted above, which is incorporated herein by reference).

The components of the fixing composition of this invention can be mixed together in any suitable order as would be known in the art, and stored indefinitely or used immediately as liquid or solid formulations. They can be formulated in aqueous concentrates such that dilution up to 10 times is required during use. Alternatively, they can be formulated as solid compositions (tablets, pellets, powders or granules) and added to a processing tank with appropriate amounts of water for use.

During photographic processing, conventional procedures can be used for replenishment of the various processing solutions, including the fixing solution. Preferably, the rate of fixing solution replenishment is not more than 3000 $ml/m^2$, and preferably from about 250 to about 1500 $ml/m^2$ of processed photographic film. The processing equipment can be any suitable processor having one or more processing tanks or vessels, including minilab processors and larger scale processors. The fixing step can be carried out in one or more tanks or stages arranged in concurrent or countercurrent flow. Generally, fixing is carried out in a two-tank or two-stage processing configuration, but single-tank or single-stage processing can also be used.

The present invention can be used advantageously with any of the known methods of applying fixing compositions to photographic elements. These methods include, but are not limited to, immersing the element into an aqueous fixing solution (with or without agitation or circulation), bringing the element into contact with a web or drum surface that is wet with the fixing composition, laminating the element with a cover sheet or web in such a way that fixing composition is brought into contact with the element, or applying the fixing composition to the element by high velocity jet or spray.

The fixing step can be carried out at a temperature of from about 20 to about 60° C. (preferably from about 30 to about 50° C.). The time of processing during this fixing step is generally up to 90 seconds and preferably at least 30 and up to 60 seconds (more preferably from about 30 to about 50 seconds). Optimal processing conditions are at 30° C. or higher temperatures. In some embodiments, higher fixing temperatures, for example from about 35 to about 55° C. can provide even more rapid fixing and minimized sensitizing dye aggregate stain in the practice of this invention.

The other processing steps can be similarly rapid or conventional in time and conditions. Preferably the other processing steps, such as color development, bleaching and stabilizing (or rinsing), are likewise shorter than conventional times. For example, color development can be carried out for from about 12 to about 150 seconds, bleaching for from about 12 to about 50 seconds, and stabilizing (or rinsing) for from about 15 to about 50 seconds in rapid processing protocols. The fixing step can be carried out more than once in some processing methods. The processing methods can have any of a wide number of arrangement of steps, as described for example in U.S. Pat. No. 5,633,124 (noted above). In such rapid processing methods, the total processing time for color negative films, can be up to 300 seconds (preferably from about 120 to about 300 seconds), and the total processing time for color negative papers can be up to 100 seconds (preferably from about 50 to about 100 seconds).

More rapid fixing times and reduced sensitizing dye aggregate stain can be brought about by higher fixing temperature, lower overall silver coverage in the processed elements, reduced silver iodide in the processed elements, reduced amounts of sensitizing dyes (especially the cyan colored dye aggregates), using sensitizing dyes with increased aqueous solubility or decreased strength of adsorption to silver halide, thinner processed elements or a greater swollen thickness to dry thickness ratio of the processed elements. Also, lower silver and/or halide (especially iodide) concentrations in the seasoned fixing composition can bring about the desired results.

The present invention can therefore be used to process silver halide elements of various types including color papers (for example EKTACOLOR RA-4), color motion picture films and prints (for example Process ECP, Process ECN and Process VNF-1), and color negative (for example Process C-41) or color reversal (for example Process E-6) films, with or without a magnetic backing layer or stripe. The various processing sequences, conditions and solutions for these processing methods are well known in the art. Preferably, color negative films, that is camera speed elements having a photographic speed of ISO 25 or higher (including those having a magnetic backing layer) are processed using this invention.

The emulsions and other components, and element structure of photographic materials used in this invention and the various steps used to process them are well known and described in considerable publications, including, for example, *Research Disclosure*, publication 38957, pages 592–639 (September 1996) and hundreds of references noted therein. Research Disclosure is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below. The invention cain be practiced with photographic films containing any of many varied types of silver halide crystal morphology, sensitizers, color couplers, and addenda known in the art, as described in the noted Research Disclosure publication and the many publications noted therein. The films can have one or more layers, at least one of which is a silver halide emulsion layer that is sensitive to electromagnetic radiation, disposed on a suitable film support (typically a polymeric material).

The processed color negative films may have a magnetic recording layer, or stripe, on the support opposite the silver halide emulsion layer(s). Formulations for preparing magnetic recording layers are also well known in the art, as described for example, in *Research Disclosure*, publication 34390, November, 1992, U.S. Pat. No. 5,395,743 (Brick et al), U.S. Pat. No. 5,397,826 (Wexler), and Japanese Kokai 6-289559 (published Oct. 18, 1994), all incorporated herein by reference. The magnetic recording layers generally include a dispersion of ferromagnetic particles in a suitable binder. While the magnetic recording layer can cover only a portion of the surface of the support, generally it covers nearly the entire surface, and can be applied using conventional procedures including coating, printing, bonding or laminating.

Various supports can be used for such color negative films processed according to this invention including the conventional acetates, cellulose esters, polyamides, polyesters, polystyrenes and others known in the art. Polyesters such as poly(ethylene terephthalate), poly(ehylene naphthalate), poly-1,4-cyclohexanedimethylene terephthalate, polyethylene 1,2-diphenoxyethane-4,4'-dicarboxylate and poly (butylene terephthalate) are preferred. These materials can be subbed or unsubbed and coated with various antihalation, antistatic or other non-imaging layers as is known in the art. Particularly useful antistatic layers on the backside of the elements include vanadium pentoxide in a suitable binder.

Representative photographic elements that can be processed to advantage using the present invention include, but are not limited to, KODAK ROYAL GOLD Color Films (especially the 1000 speed color film), KODAK GOLD MAX Color Films, KODAK ADVANTIX Color Films, KODAK VERICOLOR III Color Films, KONICA VX400 Color Film, KONICA Super SR400 Color Film, FUJI SUPER Color Films, and LUCKY Color Films. Other elements that could be used in the practice of this invention would be readily apparent to one skilled in the art.

Reagents for color development compositions are well known, and described, for example, in *Research Disclosure* (noted above), sections XVIII and XIX, and the many references described therein. Thus, besides a color developing agent, the color developers can include one or more buffers, antioxidants (or preservatives, such as sulfo-, carboxy- and hydroxy-substituted mono- and dialkylhydroxylamines), antifoggants, fragrances, solubilizing agents, brighteners, halides, sequestering agents and other conventional addenda. Representative teaching about color developing compositions can also be found in U.S. Pat. No. 4,170,478 (Case et al), U.S. Pat. No. 4,264,716 (Vincent et al), U.S Pat. No. 4,482,626 (Twist et al), U.S. Pat. No. 4,892,804 (Vincent et al), and U.S. Pat. No. 5,491,050 (Brust et al).

Preferred antioxidants useful in the color developing compositions are mono- or dialkylhydroxylamines having one or more hydroxy substituents on the one or more alkyl groups. Representative compounds of this type are described for example in U.S. Pat. No. 5,709,982 (Marrese et al), incorporated herein by reference with respect to these compounds.

Bleaching compositions are also well known, as described for example, in *Research Disclosure* (noted above), section XX and the many references noted therein. Common bleaching agents for such compositions include, but are not limited to, ferric salts or ferric binary or ternary complexes of aminopolycarboxylic acids of many various structures including but not limited to ethylenediaminetetraacetic acid, iminodiacetic acid, methyliminodiacetic acid, ethylenediaminedisuccinic acid (either the S,S isomer alone or a racemic mixture of isomers), ethylenediaminemonosuccinic acid, and others as described for example in U.S. Pat. No. 5,334,491 (Foster et al), U.S. Pat. No. 5,582,958 (Buchanan et al), U.S. Pat. No. 5,585,226 (Strickland et al), U.S. Pat. No. 5,652,085 (Wilson et al), U.S. Pat. No. 5,670,305 (Gordon et al), and U.S. Pat. No. 5,693,456 (Foster et al), all incorporated herein by reference.

Stabilizing or rinsing compositions can include one or more surfactants, and in the case of stabilizing compositions, a dye stabilizing compound such as a formaldehyde precursor, hexamethylenetetraamine or various other aldehydes such as m-hydroxybenzaldehyde. Useful stabilizing or rinsing compositions are described in U.S. Pat. No. 4,859,574 (Gonnel), U.S. Pat. No. 4,923,782 (Schwartz), U.S. Pat. No. 4,927,746 (Schwartz), U.S. Pat. No. 5,278,033 (Hagiwara et al), U.S. Pat. No. 5,441,852 (Hagiwara et al), U.S. Pat. No. 5,529,890 (Mcluckin et al), U.S. Pat. No. 5,534,396 (McGuckin et al), U.S. Pat. No. 5,578,432 (McGickin et al), U.S. Pat. No. 5,645,980 (McGuckin et al), and U.S. Pat. No. 5,716,765 (McGuckin et al), all incorporated herein by reference.

Processing according to the present invention can be carried out using conventional tanks containing processing solutions. Alternatively, it can be carried out using what is known in the art as "low volume thin tank" processing systems using either rack and tank, roller transport or automatic tray designs. Such processing methods and equipment are described, for example, in U.S. Pat. No. 5,436,118 (Carli et al) and publications cited therein.

Synthesis of Compound 1

Preparation of intermediate 2-diethylaminoethyl isothiocyanate:

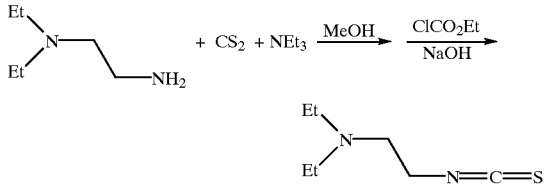

A 500 ml flask was charged with 110 ml of methanol, 2-diethylaminoethylamine (79 ml, 0.562 moles) and triethylamine (80 ml, 0.574 moles) and was cooled in a dry ice/acetone bath to −15° C. Carbon disulfide (33.6 ml, 0.56 moles) was added dropwise over 15 minutes., keeping the temperature at −10/−15 ° C., and the reaction mixture became a thick white slurry. The slurry was allowed to warm to 10° C. for 10 minutes, and was then cooled again to −15° C. Ethyl chloroformate (60 ml, 0.62 moles) was added dropwise to the thick slurry over a period of thirty minutes, while maintaining the temperature at −15° C. The reaction mixture was then warmed to ambient temperature, and it became a pale yellow slurry which was then stirred at room temperature for 30 minutes.

The yellow slurry was added to a vigorously stirred solution of NaOH (40 g, 1 mole) in 400 ml of water, while ice was added to keep the aqueous solution at 20–30° C. The product was extracted into 4×300 ml of diethyl ether, and the organic extracts were washed with brine, and dried over sodium sulfate. The extracts were concentrated under reduced pressure 89 g of a light brown oil. The crude oil was distilled under vacuum (4 mmHg, bp 90–95° C.) to give 43 g of the desired intermediate at 48.4% yield. m/e 158 for $C_7H_{14}N_2S_1$ [$^1$H NMR (dmso)-δ 3.5 (t, 2H), 2.6 (t, 2H), 2.4 (m, 4H), 0.8 (t, 6H)]

Preparation of 4-[2-(diethylamino)ethyl]-2,4-dihydro-3H-1,2,4-triazole-3-thione

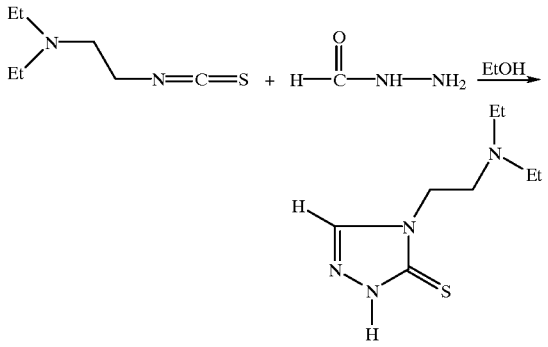

A solution of formylhydrazine (0.125 moles, 7.5 g) in ethanol (300 ml) was added to a stirred solution of 2-diethylaminocethyl isothiocyanate (0.125 moles, 19.75 g) in ethanol (100 ml). The reaction mixture was refluxed for six hours, and the solvent was removed under reduced pressure to give a yellow oil which crystallized upon standing overnight to give 23 g (92%) of the desired Compound 1. m/e 200 for $C_8H_{16}N_4S_1$ $^1$H NMR (DMSO)-δ 0.8 (t, 6H), 2.4 (m, 4H), 2.6 (t, 2H), 3.9 (t, 2H), 7.8–8.4 (m, 2H).

The following examples are included lor illustrative purposes only. Unless otherwise indicated, the percentages are by weight.

EXAMPLE 1

Fixing compositions having a fixing agent and varying additives (either compounds of Structure I, II or III or Control compounds) were prepared. Each composition also contained tetrasodium ethylenediaminetetraacetate (1 g/l), anhydrous ammonium sulfite (14.2 g/l), silver bromide (16.7 g/l), silver iodide (0.93 g/l), ammonium thiosulfate (200 g/l, 1.35 mol/l of thiosulfate ion), additive (0.0125 mol/l), and either acetic acid or ammonium hydroxide to achieve a pH of 6.5. Ammonium ions comprised at least 50 mol % of all cations in the composition. Thus, all of the tested compositions comprised a single fixing agent, that is a thiosulfate.

Compounds 1 and 2 useful in the invention were tested in fixing compositions of the invention. The Control A and B fixing compositions contained the following Additives A and B, respectively:

Additive A

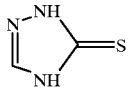

Additive B

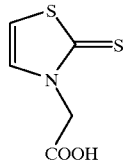

Additive A is described as a particularly preferred additive (Compound III-10) in fixing compositions in EP-A-0 712 040 (noted above), and in JP 8-190178, JP 8-262670 and JP 8-272061 (Compound 1-10). Additive B is described as Compound I-2 in EP-A-0 712 040 (noted above), and in JP 8-190178 and JP 8-262670, and as Compound II-80 in U.S. Pat. No. 5,795,703 (Ishikawa).

Samples of KODAK GOLD MAX 800 Color Film were processed after neutral exposure through a 21 step-wedge exposure target using the processing method and solutions shown in TABLE II below.

TABLE II

| PROCESSING STEP | PROCESSING SOLUTION | PROCESSING TIME |
|---|---|---|
| Color development | Kodak FLEXICOLOR Color Developer* | 195 seconds |
| Bleaching | KODAK FLEXICOLOR Bleach III* | 240 seconds |
| Washing | Water | 180 seconds |
| Fixing | As noted in TABLE III | 30, 40 or 50 seconds |
| Washing | Water | 180 seconds |
| Rinsing | PHOTOFLO Rinse* | 60 seconds |

*Commercially available from Eastman Kodak Company

The processing solutions were agitated with bursts of nitrogen bubbles and maintained at 37.8° C. in each processing step. The crossover time between fixing and water washing was only 1–2 seconds. After processing, the amount of unwanted dye stain density was determined in the film samples by measuring the maximum optical density of the sensitizing dye aggregates in the region of from 600 to 700 nm in a spectrophotometric scan of the minimum density (Dmin) in the film samples. A dye stain density of 0.05 density units ("DU") or less is considered acceptable because at this level the dye stain density is insufficient to be noticeable. TABLE III below shows the dye stain density measurements (density units, "DU") at various fixing times. Also, the method of the invention successfully removed at least 95% of the original silver from the processed film samples. Residual silver is also noted in TABLE III.

TABLE III

| Additive | Fixing Time (seconds) | DU | Residual silver ($\mu g/cm^2$) | |
|---|---|---|---|---|
| A | 30 | 0.175 | 111.8 | Control A |
| B | 30 | 0.413 | 57.6 | Control B |
| Compound 1 | 30 | 0.138 | 63.7 | Invention |
| Compound 2 | 30 | 0.113 | 70.1 | Invention |
| A | 40 | 0.100 | 69.8 | Control A |
| B | 40 | 0.363 | 35.1 | Control B |
| Compound 1 | 40 | 0.088 | 42.3 | Invention |
| Compound 2 | 40 | 0.075 | 50.6 | Invention |
| A | 50 | 0.100 | 49.1 | Control A |
| B | 50 | 0.363 | 15.1 | Control B |
| Compound 1 | 50 | 0.038 | 28.1 | Invention |
| Compound 2 | 50 | 0.050 | 33.8 | Invention |

The data in TABLE III show that the fixing compositions of this invention provided reduced dye stain density in shorter fixing times (for example 30 seconds) than the two Control fixing compositions that are taught in the prior art. The invention compositions exhibited low dye stain density and acceptable desilvering in the short fixing times. At fixing times as short as 40 seconds, the film samples treated according to the invention appeared clear and transparent, and were useful for generating quality color images by either optical printing or digital scanning processes.

Fixing with the Control A composition is too slow as evidenced by the high residual silver levels even after 50 seconds of fixing. The Control B fixing composition failed to reduce dye density stain acceptably at the three fixing times (30, 40 and 50 seconds).

EXAMPLE 2

Samples of KODAK GOLD MAX 800 Color Negative Film were exposed and processed as described in Example 1 above except that the fixing compositions contained sodium thiosulfate (200 g/l, 1.35 mol/l) and sodium thiocyanate (2.75 mol/l) as a combination of fixing agents. Control C, D and E fixing compositions were similarly formulated with the combination of fixing agents and Additives C, D and E identified as follows:

Additive C

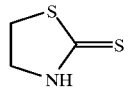

Additive D

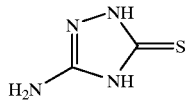

Additive E

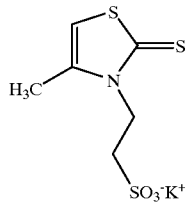

Additive C is described as a preferred additive in fixing compositions in EP-A-0 712 040 (noted above, Compound III- 31), and in JP 8-190178 and JP 8-262670, and in JP 8-272061 (Compound 1-31). Additive D is similarly described as Compound III-13 in EP-A-0 712 040, and in JP 8-190178 and JP 8-262670, and as Compound 1-13 in JP 8-272061. Additive E is similarly described as Compound I-1 in EP-A-0 712 040, and in JP 8-190178 and JP 8-262670.

Additive A was similarly used in Control A' composition containing the mixture of fixing agents.

After processing, the amount of unwanted dye stain density was determined in the film samples by measuring the maximum optical density of the sensitizing dye aggregates in the region of from 600 to 700 nm in a spectrophotometric scan of the minimum density (Dmin) in the film samples. A dye stain density of 0.05 density units ("DU") or less is considered acceptable because at this level the dye stain density is insufficient to be noticeable. TABLE IV below shows the dye stain density measurements (density units, "DU") at various fixing times. Also, the method of the invention successfully removed at least 95% of the original silver from the processed film samples. Residual silver is also noted in TABLE IV.

TABLE IV

| Additive | Fixing Time (seconds) | DU | Residual silver ($\mu g/cm^2$) | |
|---|---|---|---|---|
| A | 30 | 0.075 | 57.0 | Control A' |
| C | 30 | 0.038 | 63.1 | Control C |
| D | 30 | 0.100 | 51.3 | Control D |
| E | 30 | 0.038 | 52.1 | Control E |
| Compound 1 | 30 | 0.013 | 58.6 | Invention |
| Compound 2 | 30 | 0.013 | 58.3 | Invention |
| A | 40 | 0.050 | 39.9 | Control A' |
| C | 40 | 0.050 | 35.6 | Control C |

TABLE IV-continued

| Additive | Fixing Time (seconds) | DU | Residual silver ($\mu g/cm^2$) | |
|---|---|---|---|---|
| D | 40 | 0.075 | 29.3 | Control D |
| E | 40 | 0.138 | 27.1 | Control E |
| Compound 1 | 40 | 0.000 | 34.6 | Invention |
| Compound 2 | 40 | 0.006 | 35.9 | Invention |
| A | 50 | 0.025 | 25.9 | Control A' |
| C | 50 | 0.038 | 19.1 | Control C |
| D | 50 | 0.050 | 16.3 | Control D |
| E | 50 | 0.113 | 12.4 | Control E |
| Compound 1 | 50 | 0.000 | 21.3 | Invention |
| Compound 2 | 50 | 0.003 | 22.9 | Invention |
| A | 60 | 0.013 | 18.0 | Control A' |
| C | 60 | 0.013 | 10.8 | Control C |
| D | 60 | 0.031 | 10.2 | Control D |
| E | 60 | 0.000 | 6.9 | Control E |
| Compound 1 | 60 | 0.000 | 13.5 | Invention |
| Compound 2 | 60 | 0.000 | 15.3 | Invention |

The data in TABLE IV show that for the use of Controls C and E, dye stain density increases after 30 seconds of fixing before finally decreasing. In contrast, each Invention composition prevented dye stain density from increasing. At each fixing time, the Invention compositions reduced dye stain density consistently compared to the Control compositions that are suggested in the prior art. This reduction or control of dye stain density was achieved without negatively affecting the rate of silver removal from the film samples.

While the advantages of the invention are well illustrated in these examples, it is understood that the advantages would be even more evident if the level of silver or silver iodide in the film samples was less. Thus, even shorter fixing times could be achieved. In addition, if the level of silver or iodide was reduced in the fixing compositions, fixing time could be further reduced with similar effect on dye stain density. Still further, if the film samples were less thick so that they were swollen to a lesser degree during a processing, even shorter fixing times could be achieved with similar reduction in dye stain density.

The invention has been described in detail with particular reference to preferred embodiments thereof, but it will be understood that variations and modifications can be effected within the spirit and scope of the invention.

We claim:

1. A fixing composition comprising:

a) at least 0.5 mol/l of a thiosulfate fixing agent, and b) at least 0.001 mol/l of a triazole of Structure I, II or III or any of their tautomeric forms:

I

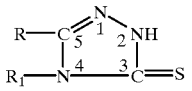

II

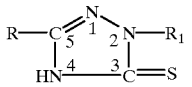

III

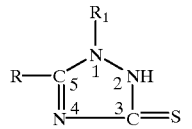

wherein R and $R_1$ are independently hydrogen or a monovalent substituent, provided that the triazole of Structure I, II or III or any of its tautomeric forms has at least one aminoalkyl group that has up to 12 carbon atoms in the alkyl portion attached to the triazole ring, and any two adjacent substituent or aminoalkyl groups can together form a fused ring with the triazole ring, provided that R and $R_1$ are not both hydrogen, and neither is an amino group, wherein the concentration of ammonium ions is at least 50 mol % of all cations in said composition.

2. The fixing composition of claim 1 wherein R and $R_1$ is hydrogen or an aminoalkyl group having from 1 to 8 carbon atoms in the alkyl portion.

3. The fixing composition of claim 2 wherein at least one of R and $R_1$ is a dimethylaminoethyl, diethylaminoethyl or morpholinoethyl group.

4. The fixing composition of claim 1 wherein said triazole of Structure I, II or III comprises two aminoalkyl groups that are the same or different.

5. The fixing composition of claim 1 wherein said triazole of Structure I, II or III is any of Compounds 1 to 8, wherein Compounds 1 to 8 are

1

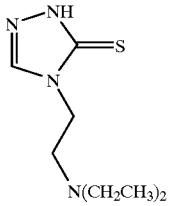

2

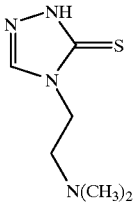

3

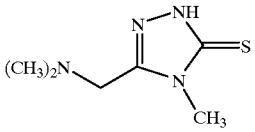

4

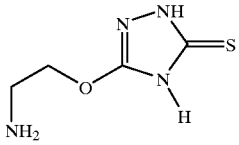

5

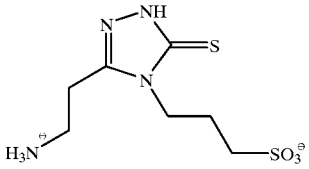

-continued

6

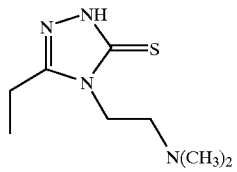

7

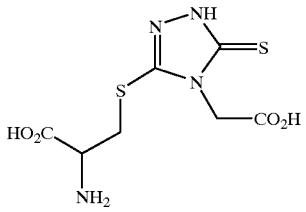

8

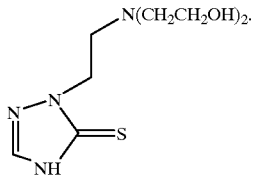

6. The fixing composition of claim 5 wherein said triazole of Structure I, II or III is Compound 1 or 2, wherein Compounds 1 and 2 are

1

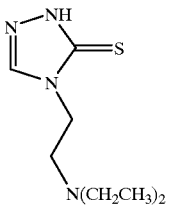

2

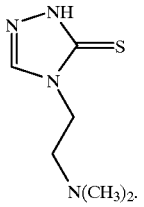

7. The fixing composition of claim 1 that is an aqueous composition having a pH of from about 4 to about 8.

8. The fixing composition of claim 1 wherein said fixing agent is a thiosulfate that is present at a concentration of from about 0.5 to about 1.6 mol/l.

9. The fixing composition of claim 1 comprising both thiosulfate and thiocyanate fixing agents, the amount of thiocyanate fixing agent being at least 2 mol/l.

10. The fixing composition of claim 1 wherein said triazole of Structure I, II or III is present at a concentration of from about 0.005 to about 0.05 mol/l.

11. The fixing composition of claim 1 wherein the concentration of ammonium ions is at least 75 mol % of all cations.

12. An aqueous fixing composition having a pH of from about 4 to about 8, and comprising:

a) from about 0.8 to about 1.5 mol/l of a thiosulfate fixing agent, b) from about 2 to about 3 mol/l of a thiocyanate fixing agent, and c) from about 0.005 to about 0.05 mol/l of Compound 1 or 2, wherein the concentration of ammonium ions is at least 75 mol % of all cations in said composition, and said composition contains no purposely added bleaching agents, wherein Compounds 1 and 2 are

1

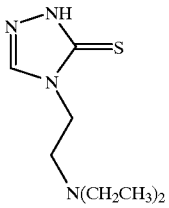

2

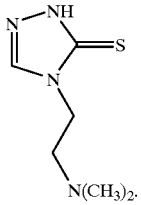

13. A method of photographic processing comprising:

contacting an imagewise exposed and color developed color photographic silver halide element with the fixing composition of claim 1 for up to 60 seconds.

14. The method of claim 13 wherein said element has been bleached before contacting with said fixing composition.

15. The method of claim 14 wherein said contacting is carried out for up to 50 seconds.

16. The method of claim 15 wherein said contacting is carried out for from about 30 to about 50 seconds.

17. The method of claim 13 wherein at least 95 mol % of the original removable silver(I) in said element is dissolved during said contacting step, and the residual dye stain after contacting with said fixing composition is less than 0.05 density units of dye stain density in the region of 600 to 700 nm.

18. The method of claim 13 wherein said color photographic silver halide element is a color negative film.

19. The method of claim 13 wherein said contacting is carried out at a temperature of from about 20 to about 60° C.

20. A method of photographic processing comprising:

A) color developing an imagewise exposed color negative film having a photographic speed of ISO 25 or more with a color development composition comprising a color developing agent, B) bleaching said color developed color negative film with a bleaching composition comprising a bleaching agent, C) fixing said bleached color negative film for up to 50 seconds with a fixing composition having a pH of from about 4 to about 8 and comprising:

a) from about 0.8 to about 1.5 mol/l of a thiosulfate fixing agent, b) from about 2 to about 3 mol/l of a thiocyanate fixing agent, and c) from about 0.005 to about 0.05 mol/l of a triazole of structure I, II or III or their tautomeric forms:

I

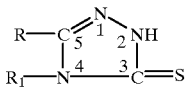

II

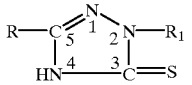

III

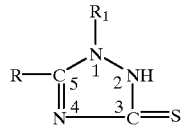

wherein R and $R_1$ are independently hydrogen or a monovalent substituent,provided that the triazole of Structure I, II or III or any of its tautomeric forms has at least one aminoalkyl group that has up to 12 carbon atoms in the alkyl portion attached to the triazole ring, and any two adjacent substituent or aminoalkyl groups can together form a fused ring with the triazolie ring, provided that R and $R_1$ are not both hydrogen, and neither is an amino group, wherein the concentration of ammonium ions is at least 75 mol % of all cations in said fixing composition, and D) rinsing or stabilizing said fixed color negative film with a rinsing or stabilizing composition.

21. The method of claim 20 wherein said fixing step C is carried out at a temperature of from about 30 to about 50° C., and said fixing composition contains no purposely added bleaching agents.

22. The method of claim 20 wherein said color developing step A is carried out for from about 12 to about 150 seconds, said bleaching step B is carried out for from about 12 to about 50 seconds, and said stabilizing or rinsing step D is carried out for from about 15 to about 50 seconds.

23. The method of claim 20 that is carried out within a total time of from about 120 to about 300 seconds for steps A through D.

24. The method of claim 13 wherein the triazole of Structure I, II or III is Compound 1 or 2, wherein Compounds 1 and 2 are

1

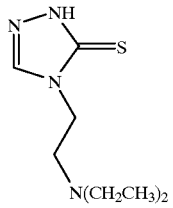

2

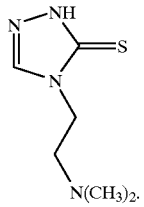

* * * * *